US006558138B2

(12) United States Patent
Tseng

(10) Patent No.: US 6,558,138 B2
(45) Date of Patent: May 6, 2003

(54) MANUAL/PNEUMATIC OIL-PUMPING DEVICE

(76) Inventor: Tien Tsai Tseng, No. 771, Lin Sen Road, Wu Feng Hsiang, Taichung Hsien (TW)

( * ) Notice: Subject to any disclaimer, the term of this patent is extended or adjusted under 35 U.S.C. 154(b) by 0 days.

(21) Appl. No.: 09/930,986

(22) Filed: Aug. 17, 2001

(65) Prior Publication Data

US 2003/0035741 A1 Feb. 20, 2003

(51) Int. Cl.[7] ..... F04B 9/14

(52) U.S. Cl. ..... 417/374; 417/40; 417/118; 137/205

(58) Field of Search ..... 417/40, 41, 118, 417/148, 374; 184/1.5; 137/205, 365

(56) References Cited

U.S. PATENT DOCUMENTS 1,960,389 A * 5/1934 McFerran, Jr. ..... 222/146.2
2,477,450 A * 7/1949 Gray ..... 184/1.5
5,002,154 A * 3/1991 Chen ..... 184/1.5
6,092,390 A * 7/2000 Griffith, Jr. ..... 62/468

* cited by examiner

*Primary Examiner*—Charles G. Freay
*Assistant Examiner*—John F Belena
(74) *Attorney, Agent, or Firm*—Rosenberg, Klein & Lee

(57) ABSTRACT

A manual/pneumatic oil pumping device including a housing having an upper cover equipped with a manual mechanism and a pneumatic air sucking mechanism. A closing means is disposed in the upper cover corresponding to the pneumatic air sucking mechanism. When the closing means is in an opened state, the oil reserving space communicates with the pneumatic air sucking mechanism so that the pneumatic air sucking mechanism can suck out the air in the oil reserving space and thus pump the oil. When the closing means is in a closed state, the oil reserving space does not communicate with the pneumatic air sucking mechanism and a user can manually pump the oil.

3 Claims, 9 Drawing Sheets

MANUAL/PNEUMATIC OIL-PUMPING DEVICE

BACKGROUND OF THE INVENTION

The present invention is related to a manual/pneumatic oil-pumping device which can be switched between manual operation mode and pneumatic operation mode without detaching any parts.

FIG. 6 shows a conventional manual oil-pumping device including an oil reservoir 7. An upright pump 8 is connected between the upper and lower covers 71, 72 of the oil reservoir 7. A piston 81 is disposed in the pump 8. The piston stem 82 of the piston 81 extends through the upper cover 71 to connect with a handle 83 for manual operation. The upper cover 71 is formed with an air incoming passage 711 communicating with the interior space 73 of the oil reservoir 7 and the interior space of the pump 8. The inlet 712 of the air incoming passage 711 is provided with a one-way air incoming valve 713 connected with a float 714. The lower cover 72 is provided with a one-way pressure relieving valve 74 inside the pump 8.

When a user holds and upward pulls the handle to lift the piston 81, the air above the piston 81 is compressed to flow to lower side of the piston 81. When the user pushes the piston stem 82 downward to lower the piston 81, the air thereunder will pass through the pressure relieving valve 74 and is relieved. The air pressure above the piston 81 is reduced, whereby the air in the reservoir space 73 will pass through the air incoming valve 713 and enter the pump 8. As a result, the oil is sucked from the sucking tube into the reservoir space 73. Accordingly, when the user up and down pulls the piston stem 82, the oil in the oil tank can be sucked into the oil reservoir 7. When the oil in the oil reservoir 7 reaches a certain height, the float 714 buoys upward to shut off the air incoming valve 713 and prevent the oil from getting into the pump 8.

The above oil-pumping device is manually operated, and it is time-consuming and laborious to operate the oil pumping device.

FIGS. 7 and 8 show a manual/pneumatic oil-pumping device. The oil reservoir 9 is equipped with a pneumatic air sucking mechanism 91 which is connected to an air compressing mechanism (not shown). When activating the air compressor, the air in the oil reservoir 9 is directly sucked out, whereby the oil is sucked through the oil sucking tube 93 into the oil reservoir 9. When converted into manual operation mode, it is necessary to detach the pneumatic sucking mechanism 91 and then mount the manual operation mechanism 92 on the oil reservoir 9. Such procedure is quite troublesome and it is necessary to store the detached aparts in an additional room. Under such circumstance, it is easy to misplace the parts.

SUMMARY OF THE INVENTION

It is therefore a primary object of the present invention to provide a manual/pneumatic oil-pumping device. The upper cover of the oil-pumping device is equipped with a manual mechanism, a pneumatic mechanism and a closing means. When converted between manual operation mode and pneumatic operation mode, it is unnecessary to detach any parts from the device so that it is convenient to operate the device, and the parts of the device are prevented from being misplaced.

The present invention can be best understood through the following description and accompanying drawings wherein:

DETAILED DESCRIPTION OF THE PREFERRED EMBODIMENTS

Figure 1:
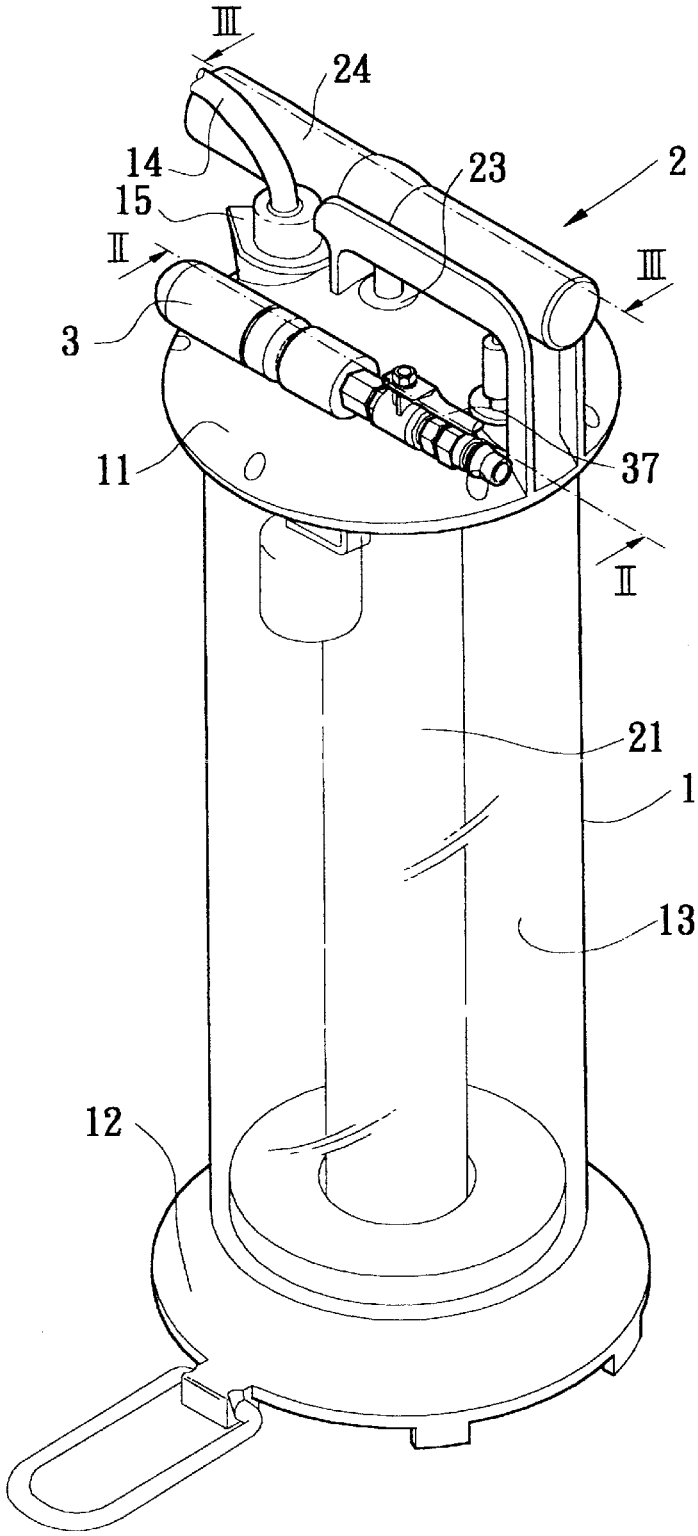
FIG. 1 is a perspective assembled view of the present invention.
Figure 2:
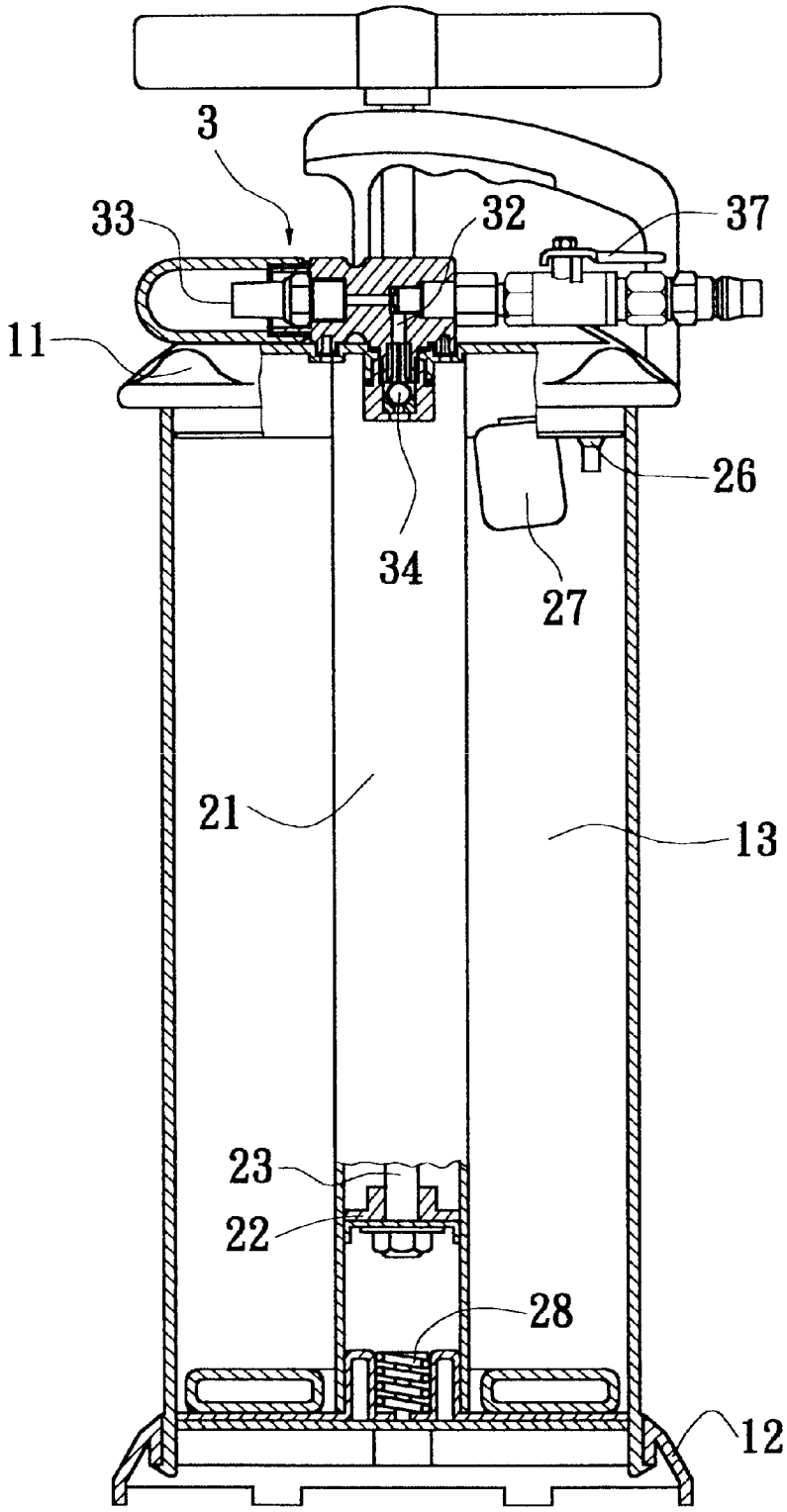
FIG. 2 is a partially sectional view taken along line II of FIG. 1.
Figure 3:
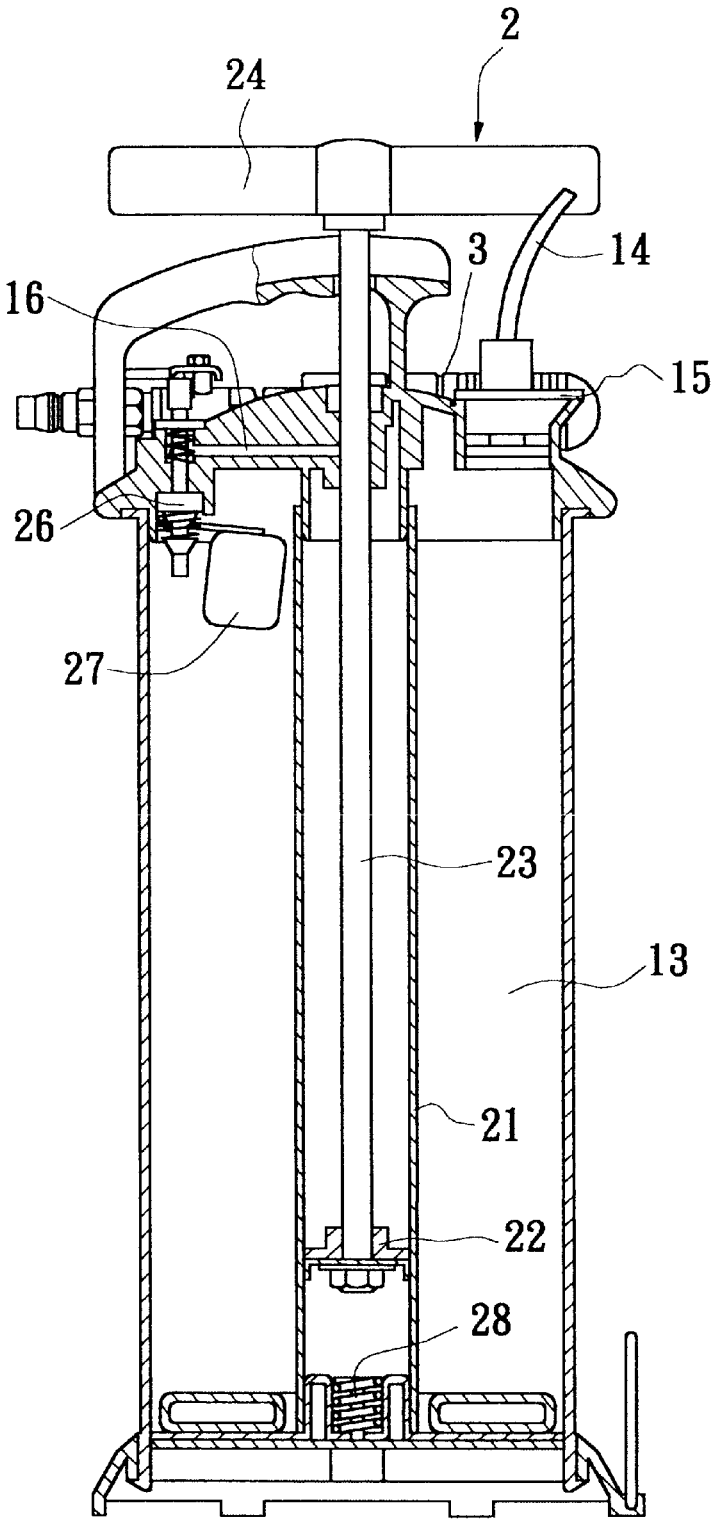
FIG. 3 is a partially sectional view taken along line III—III of FIG. 1.

Referring to FIGS. 1 to 5, the manual/pneumatic oil-pumping device of the present invention includes a housing 1 having an upper cover 11 and a lower cover 12. An oil sucking hose 14 is connected to an oil sucking hose seat 15 of the upper cover 11. The upper cover 11 is equipped with a manual mechanism 2 and a pneumatic air sucking mechanism 3. The manual mechanism 2 includes an upright pump 21 disposed in the housing 1. The top and bottom ends of the pump 21 are sealed by the upper and lower covers 11, 12. An oil reserving space 13 is defined between the housing 1 and the pump 21. A piston 22 is disposed in the pump 21. A piston stem 23 of the piston 22 extends through the upper cover 11 and is provided with a handle 24 for a user to hold. The upper cover 11 is formed with an air incoming passage 16 communicating with the oil reserving space 13 and the pump 21. The upper cover 11 is provided with a one-way air incoming valve 26 corresponding to the air incoming passage 16. The air incoming valve 26 is provided with a float 27. The float 27 serves to shut off the air incoming valve 26 to prevent the oil from spilling and thus prevent the oil from entering the air incoming passage 16. The lower cover 12 is provided with a one-way pressure relieving valve 28 corresponding to the interior of the pump 21.

Figure 4A:
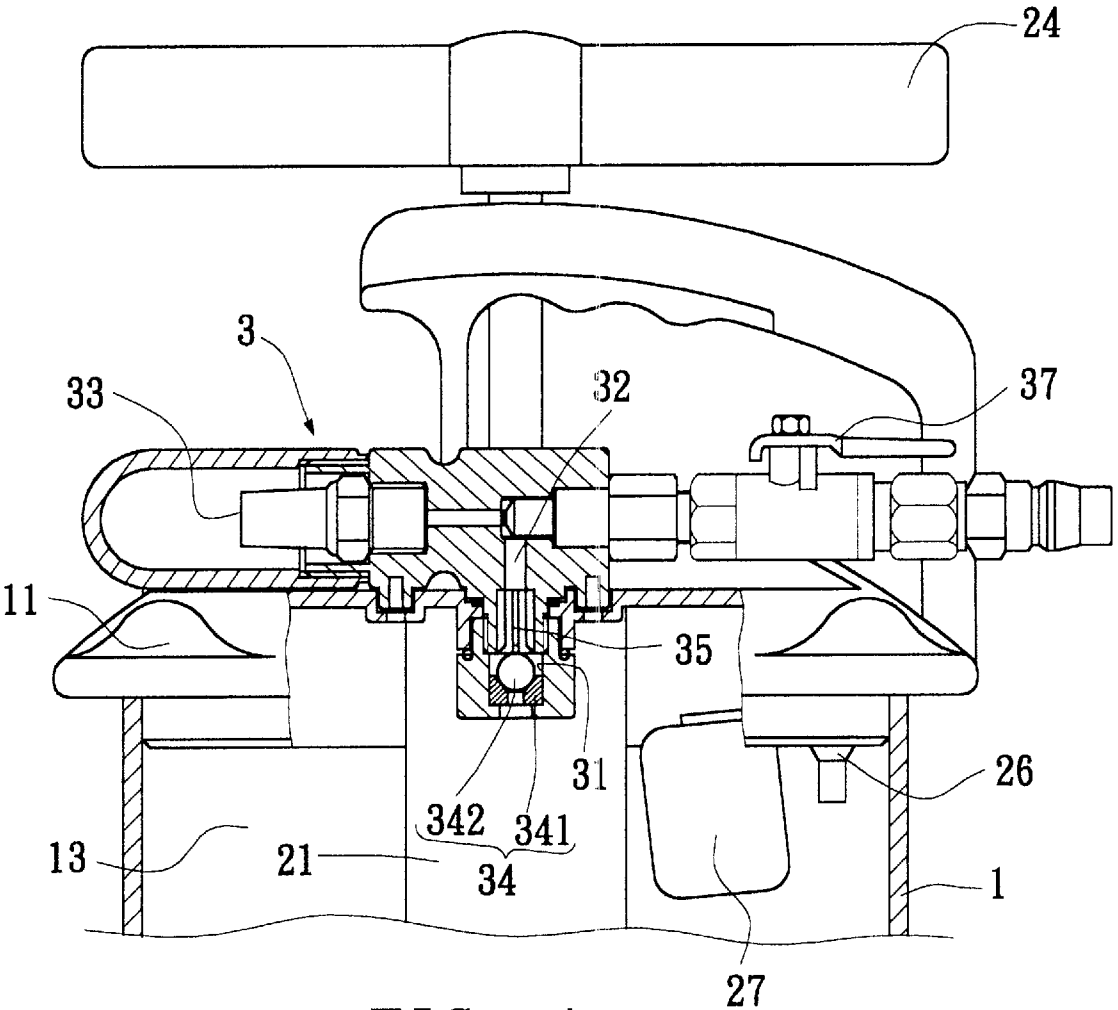
FIG. 4*a* is a partially sectional view showing the closing means of the present invention in a closed state, in which the ball body blocks the conic hole and the air sucking port does not communicate with the oil reserving space.

The upper cover 11 is further provided with an air sucking port 31 axially passing through the upper cover 11 (as shown in FIG. 4*a*). The air sucking port 31 communicates with the oil reserving space 13. The pneumatic air sucking mechanism 3 is disposed corresponding to the top end of the air sucking port 31, whereby the internal way 32 of the pneumatic air sucking mechanism 3 communicates with the air sucking port 31 and the air can flow between the way 32 and the air sucking port 31. One end of the pneumatic air sucking mechanism 3 is connected to a conventional pressure source such as an air compressor (not shown). The other end of the pneumatic air sucking mechanism 3 has an air outlet 33. In addition, the pneumatic air sucking mechanism 3 has a switch 37 corresponding to the air compressor for controlling the communication between the internal way 32 and the air compressor.

A closing means 34 is disposed in the air sucking port 31, including an accommodating member 341 and a blocking body 342. In this embodiment, the blocking body 342 is a ball body and the accommodating member 341 has a downward tapered conic hole 343 passing through the accommodating member 341. The diameter of the ball body 342 is smaller than the large diameter of the conic hole 343 while larger than the small diameter thereof. In normal state, the ball body 342 due to its own weight drops onto and blocks the conic hole 343 so as to prevent the oil reserving space 13 from communicating with the air sucking port 31. A stop member 35 is disposed in the air sucking port 31 of the pneumatic air sucking mechanism 3 for stopping the ball body 342, permitting the air to flow from the air sucking port 31 to the way 32.

When manually pumping the oil, a user directly holds the handle 24 of the manual mechanism 2 and pulls the handle 24 up and down, whereby the air in the oil reserving space 13 flows from the one-way air incoming valve 26 and the air incoming passage 16 into the pump 21 and then discharges from the one-way pressure relieving valve 28. At this time, the oil reserving space 13 is in a negative pressure state, whereby the oil goes from the oil sucking hose 14 into the oil reserving space 13. In addition, when the air pressure in the oil reserving space 13 is lower and lower and a negative pressure is formed, the ball body 342 is also sucked downward to more tightly block the conic hole 343. Therefore, the closing means 34 automatically forms a closed state so as to prevent the air sucking port 31 from communicating with the oil reserving space 13. Accordingly, leakage of air is avoided and the user can well manually pump the oil.

Figure 4B:
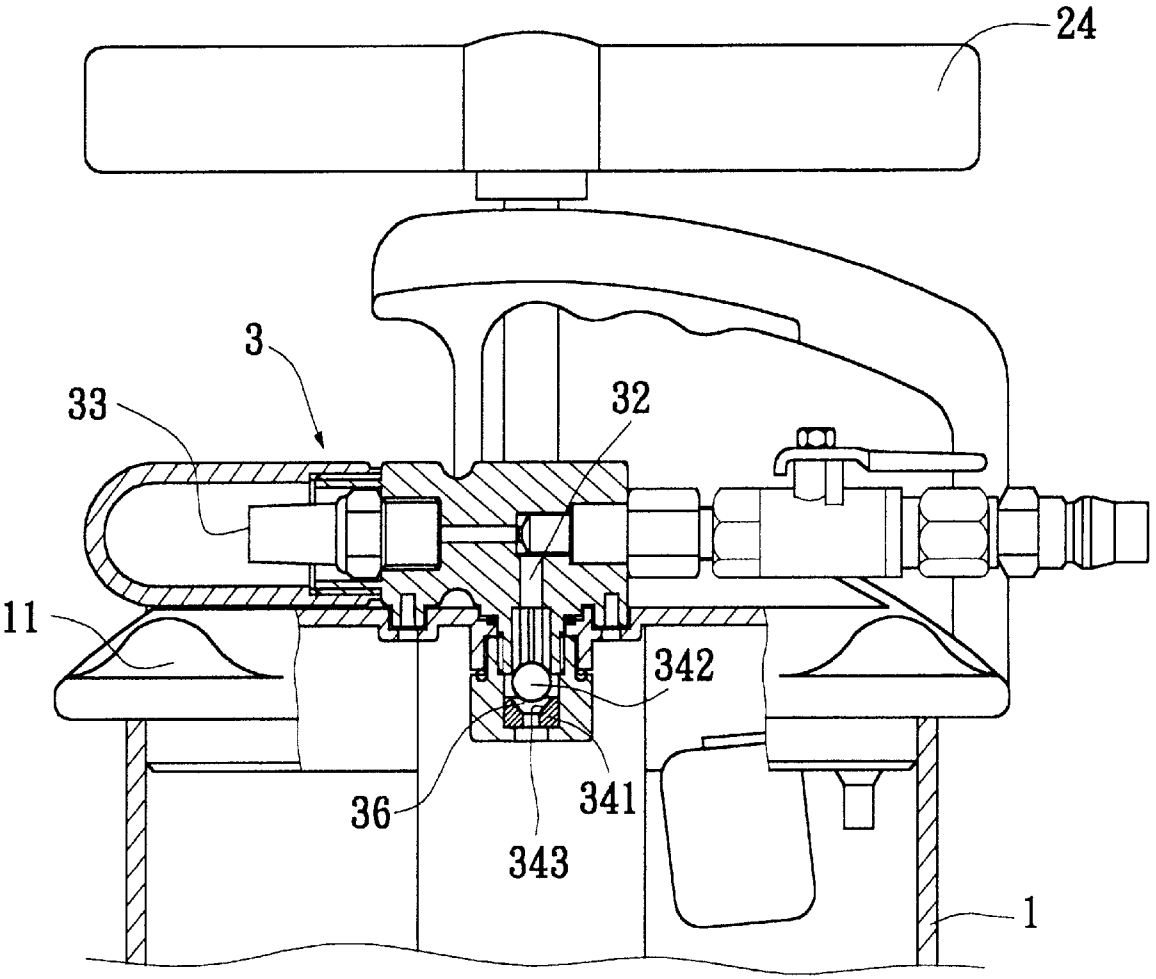
FIG. 4*b* is a partially sectional view showing the closing means of the present invention in an opened state, in which the ball body is sucked upward and a communicating space is defined between the ball body and the wall of the conic hole.
Figure 5:
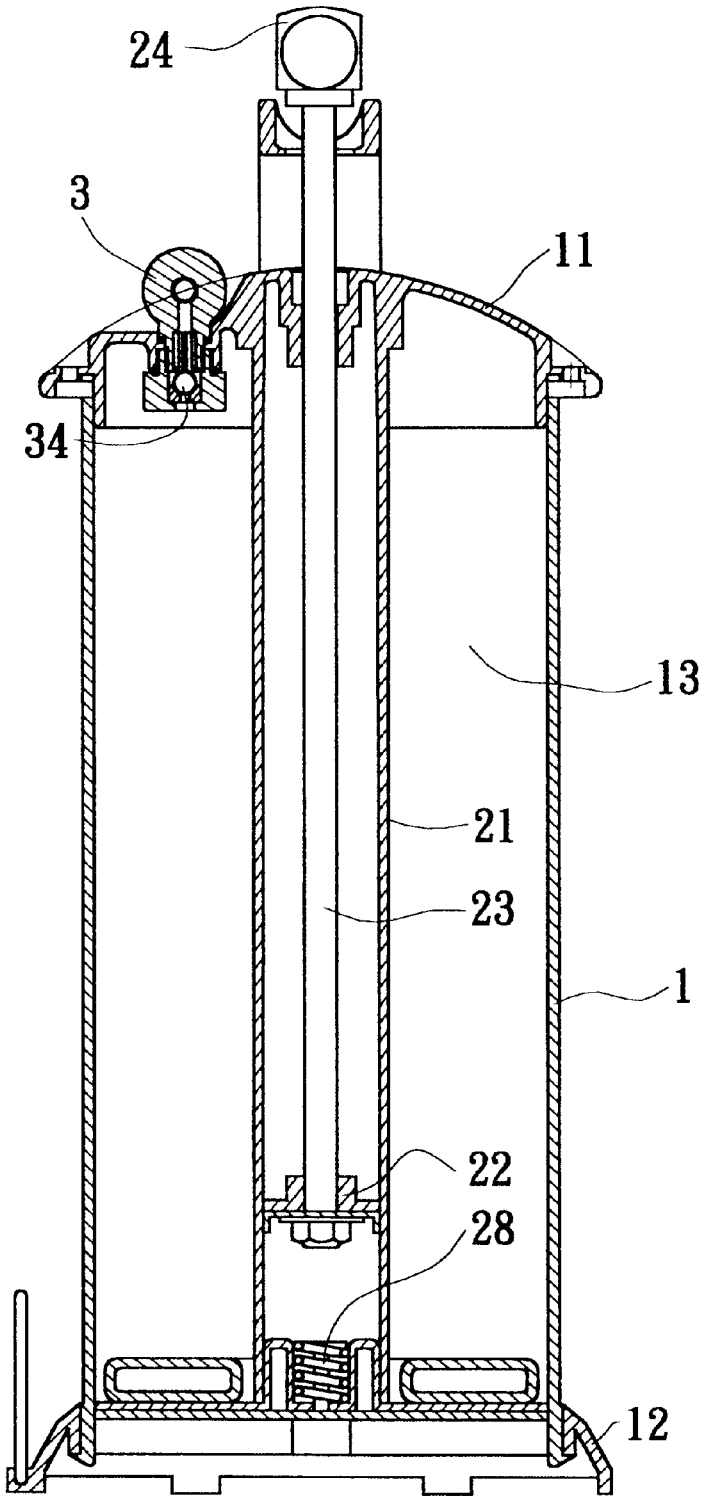
FIG. 5 is a side view of another embodiment of the present invention.
Figure 6:
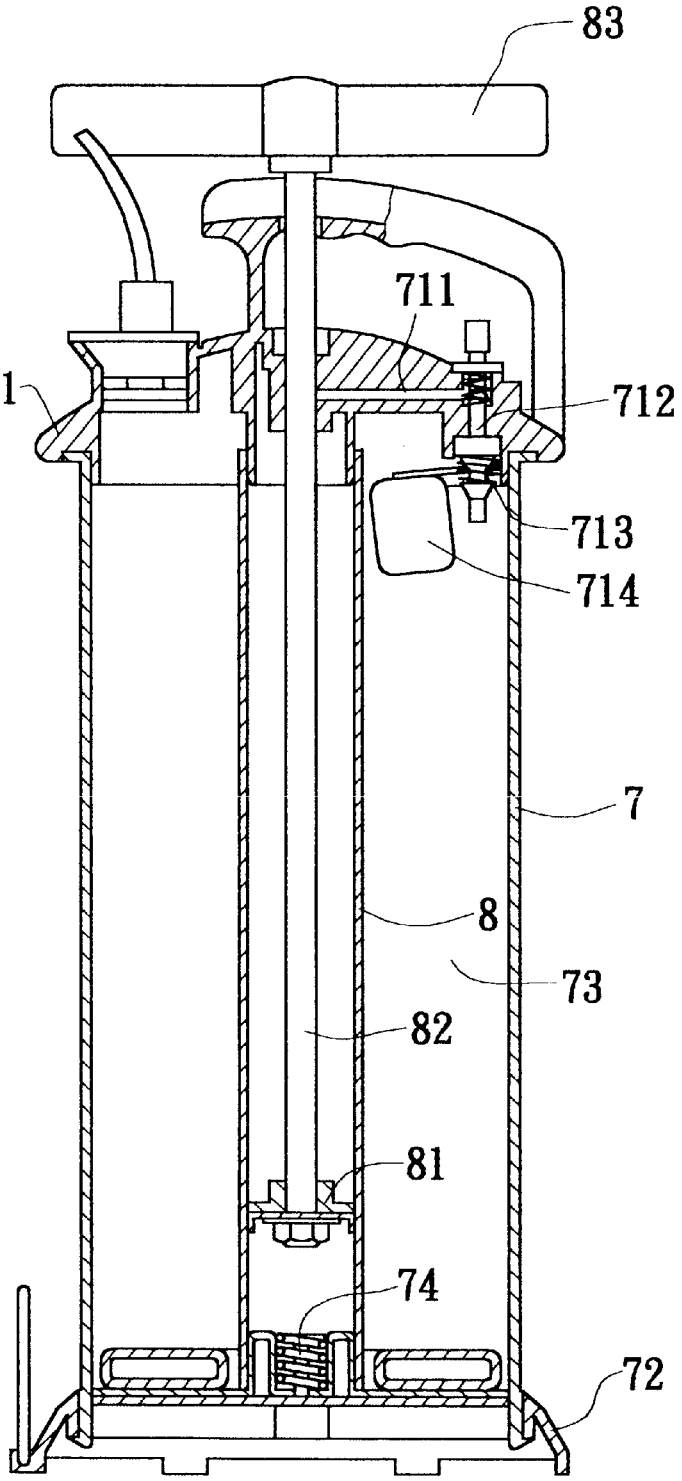
PRIOR ART FIG. 6
FIG. 6 is a partially sectional view of a conventional oil-pumping device.
Figure 7:
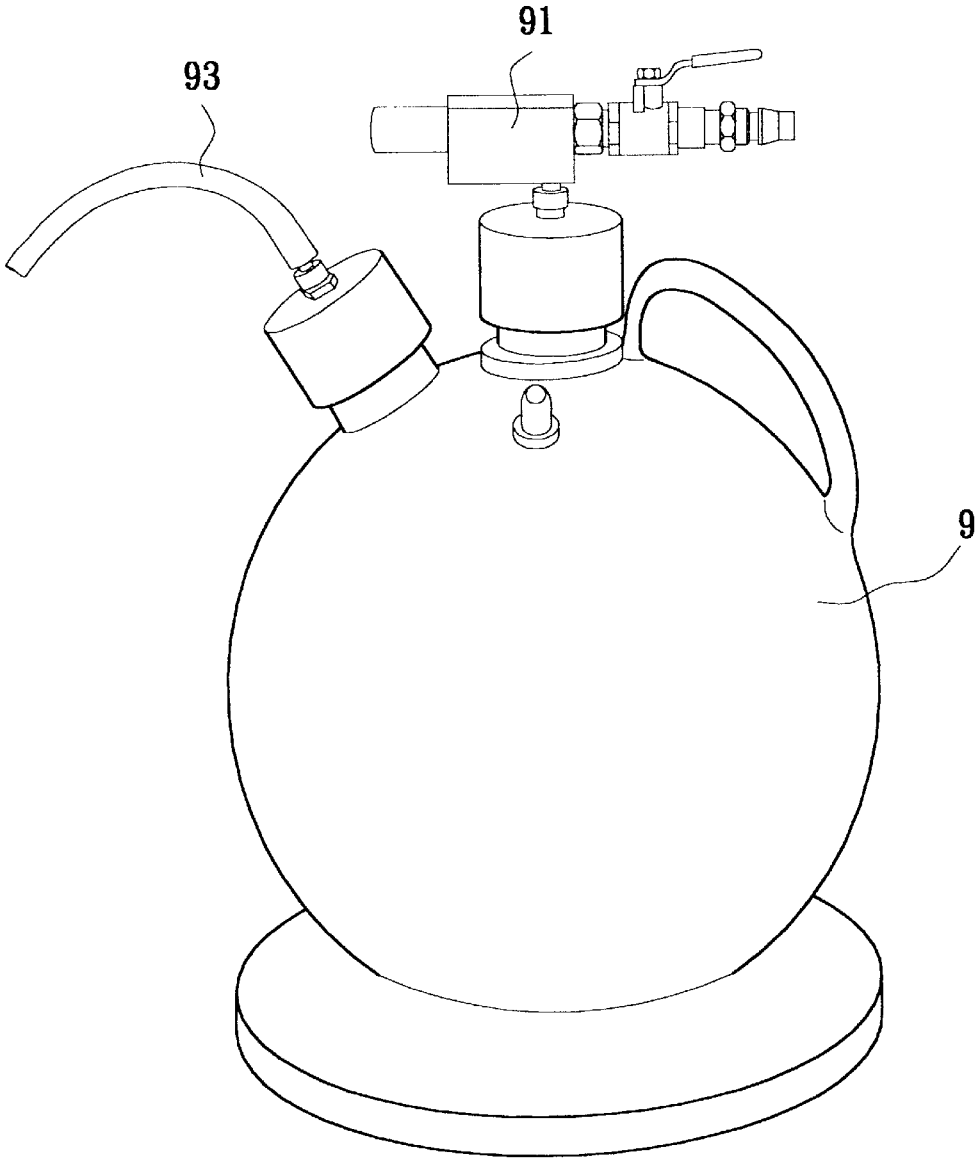
PRIOR ART FIG. 7
FIG. 7 is a perspective view of a conventional manual/pneumatic oil-pumping device, in which the oil-pumping device is in pneumatic operation state.
Figure 8:
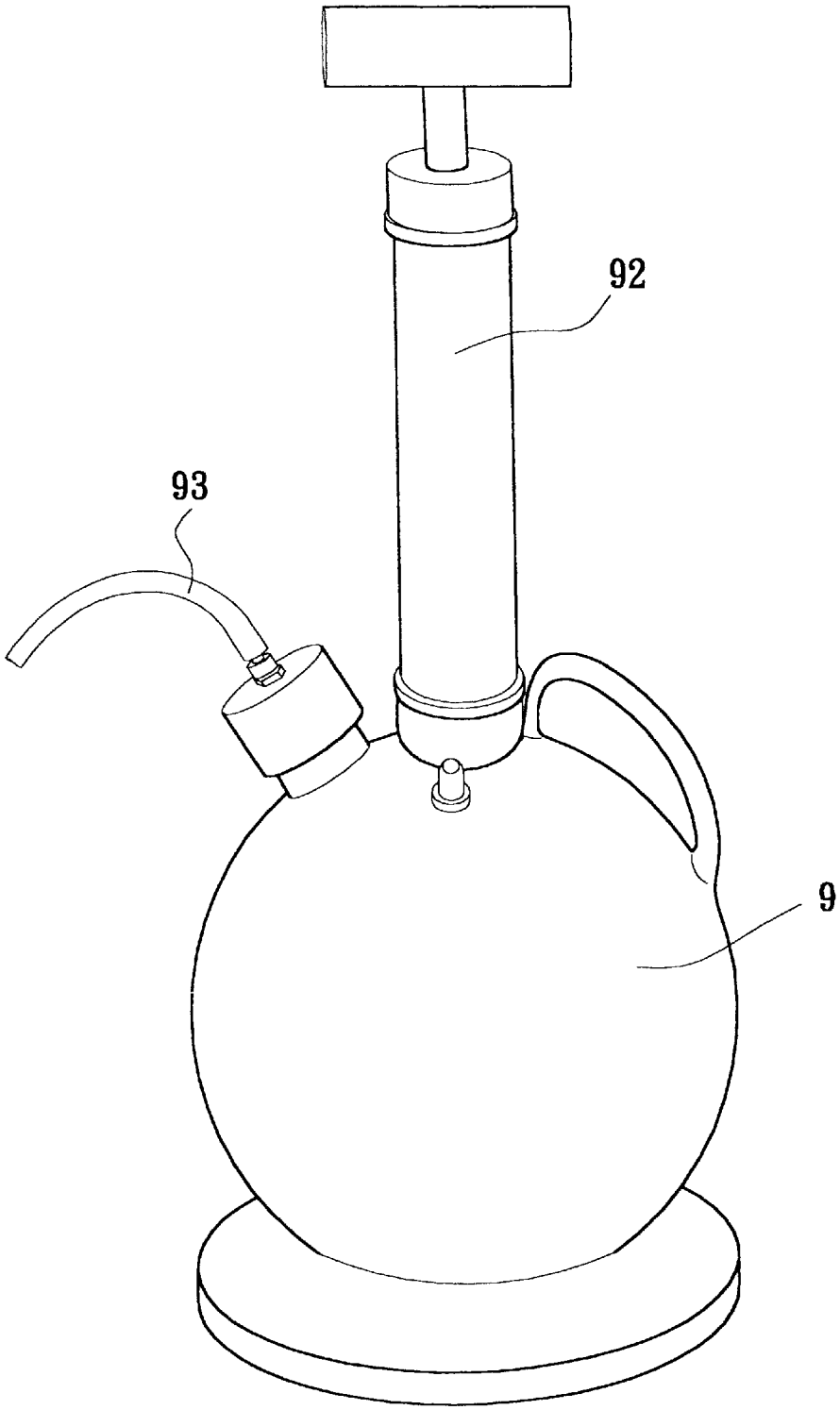
PRIOR ART FIG. 8
FIG. 8 is a perspective view of the device shown in FIG. 7, in which the oil-pumping device is in manual operation state.

Referring to FIG. 4*b,* when the user desires to pneumatically pump the oil, the user only needs to connect the pneumatic air sucking mechanism 3 with the air compressor and switch on the switch 37 and activate the air compressor. At this time, the air compressor injects high pressure air into the pneumatic air sucking mechanism 3. When the high pressure air passes through the top end of the air sucking port 31, the air therein will be sucked away due to siphon effect. At the same time, the ball body 342 is sucked upward and the closing means 34 automatically forms an opened state, whereby a communicating space 36 is defined between the ball body 342 and the wall of the conic hole 343. Accordingly, the air in the oil reserving space 13 is sucked away through the communicating space 36 to form a negative pressure state. At this time, the oil can flow through the oil sucking hose 14 into the oil reserving space 13. In addition, when sucked upward to a certain extent, the ball body 35 is stopped by the stop member 35 so as to prevent the ball body 342 from being sucked away along with the air.

According to the above arrangement, a user can select a suitable measure to pump oil in accordance with the environment and equipment. When converted from manual measure to pneumatic measure or from pneumatic measure to manual measure, the closing means will be automatically switched between opened state and closed state. Therefore, it is no more necessary to detach any parts from the device so that the conversion is convenient.

In addition, since it is unnecessary to detach any parts for converting the pumping measure, the possibility of missing the parts is eliminated.

Furthermore, the pneumatic air sucking mechanism and manual mechanism are both mounted on the upper cover so that the volume of the oil pumping device is not increased. Moreover, when it is desired to pour out the oil in the housing, the user only needs to extract the oil sucking hose seat 15.

There are many modifications of the above embodiment. For example, the closing means can be a manually controlling valve disposed in the air sucking hole of the upper cover corresponding to the pneumatic air sucking mechanism. When the controlling valve is in opened state, the air sucking port communicates with the oil reserving space and a user can pneumatically pump the oil. In the case that the controlling valve is closed, the air sucking port does not communicate with the oil reserving space and a user can manually pump the oil. This achieves the same function as the first embodiment.

The above embodiments are only used to illustrate the present invention, not intended to limit the scope thereof. Many modifications of the above embodiments can be made without departing from the spirit of the present invention.

What is claimed is:

1. A manual/pneumatic oil-pumping device comprising: a housing having an upper cover, the upper cover being equipped with a manual mechanism and a pneumatic air sucking mechanism, the manual mechanism including a pump, a top and bottom ends of the pump being respectively sealed by the upper cover and a bottom of the housing, a piston being disposed in the pump, the piston having a piston stem provided with a handle where the piston stem extends through and out of the upper cover, an oil reserving space being defined between the pump and the housing, whereby when a user pushes the handle in and out to reciprocate the piston, an air in the oil reserving space is sucked into the pump and discharged so as to suck an oil into the oil reserving space, said oil-pumping device being characterized in that the upper cover is further provided with an air sucking port axially passing through the upper cover and communicating with the oil reserving space, the pneumatic air sucking mechanism being disposed to operate with the air sucking port, whereby the air can flow between the air sucking port and the interior of the pneumatic air sucking mechanism, a closing means being disposed in the air sucking port, whereby when pneumatically pumping the oil, the closing means is in an opened state and the air sucking port communicates with the oil reserving space so that the pneumatic air sucking mechanism can suck the air in the oil reserving space and thus suck an oil into the oil reserving space; and when manually pumping the oil, the closing means being in a closed state, the closing means automatically switched between closed state and opened state when converted between manual pumping and pneumatic pumping measures, the closing means including an accommodating member and a blocking body, the accommodating member having a bottom directed tapered conic hole passing through the accommodating member, the conic hole including a bottom end having a diameter smaller than that of an upper end of the conic hole, the blocking body being received in the conic hole and larger than the diameter of the bottom end of the conic hole, whereby in a normal state, the blocking body due to its own weight blocks the conic hole; and when pneumatically pumping the oil, the blocking body being sucked towards a stop, permitting the air sucking port to communicate with the oil reserving space.

2. The manual/pneumatic oil-pumping device as claimed in claim 1, wherein the blocking body is a ball body having a diameter larger than that of the lower end of the conic hole, whereby in the normal state, the ball body due to its own weight blocks the conic hole.

3. The manual/pneumatic oil-pumping device as claimed in claim 1, wherein the upper cover is formed with an air incoming passage communicating with the oil reserving space and on interior of the pump, the upper cover being provided with a one-way air incoming valve corresponding to the air incoming passage, whereby when manually pumping the oil, the air in the oil reversing space flows from the one-way air incoming valve and the air incoming passage into the pump, the air incoming valve being provided with a float serving to shut off the air incoming valve to prevent the oil from spilling and thus prevent the oil from entering the air incoming passage, the pneumatic air sucking mechanism being provided with a switch for connecting with a pressure source.

* * * * *